US009125495B2

(12) United States Patent
Baker et al.

(10) Patent No.: US 9,125,495 B2
(45) **Date of Patent: *Sep. 8, 2015**

(54) ARTICULATED CHAIR HAVING UNIVERSAL RECLINING ARMREST SYSTEM

(71) Applicant: Medical Technologies Industries, Inc., Salt Lake City, UT (US)

(72) Inventors: Jeff Baker, Cottonwood Heights, UT (US); Mike Bradfield, Riverton, UT (US); Brad Baker, Riverton, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/937,017

(22) Filed: Jul. 8, 2013

(65) Prior Publication Data

US 2014/0159456 A1 Jun. 12, 2014

Related U.S. Application Data

(63) Continuation of application No. 12/982,815, filed on Dec. 30, 2010, now Pat. No. 8,480,172, which is a continuation of application No. 12/324,836, filed on Nov. 27, 2008, now Pat. No. 7,862,123.

(51) Int. Cl.
*A47C 7/54* (2006.01)
*A61G 15/00* (2006.01)
(Continued)

(52) U.S. Cl.
CPC ... *A47C 7/54* (2013.01); *A47C 1/02* (2013.01); *A47C 7/543* (2013.01); *A61G 15/02* (2013.01)

(58) Field of Classification Search
CPC ..... A47C 7/54; A47C 7/543; A47C 1/02; A61G 15/02
USPC ..... 297/411.31, 411.32, 411.33, 411.35, 297/411.36, 411.38, 411.39, 115, 116, 330
See application file for complete search history.

(56) References Cited

U.S. PATENT DOCUMENTS 2,306,031 A 12/1942 Anderson et al.
2,661,227 A 12/1953 Murphy
(Continued)

FOREIGN PATENT DOCUMENTS

DE 2226572 12/1973
EP 0442627 A2 8/1991
(Continued)

OTHER PUBLICATIONS

Brochure: Installation and Operating Instructions, Reliance Medical Products, Inc., Owner's Manual, Models 880, 980, 981, Apr. 1992.
(Continued)

*Primary Examiner* — Rodney B White
(74) *Attorney, Agent, or Firm* — David B. Tingey; Bryant J. Keller; Kirton McConkie

(57) ABSTRACT

A universal reclining armrest system for use with an articulated examination chair. The system includes an armrest adapter having a universal aperture for receiving a post portion of an armrest assembly. The armrest adapter further includes a splined peg for coupling to a pivoting mechanism of an articulated chair. The pivoting mechanism enables the chair to move throughout an operable range of motion while maintaining a fixed rotational position of an attached armrest adapter. The armrest assembly further includes an adjustable joint to provide 360° of rotational adjustment to the armrest relative to the fixed position of the armrest adapter.

21 Claims, 18 Drawing Sheets

(51) Int. Cl.
*A61G 15/02* (2006.01)
*A47C 1/02* (2006.01)

(56) References Cited

U.S. PATENT DOCUMENTS

| | | | |
|---|---|---|---|
| 3,338,632 | A | 8/1967 | Kleinsorge |
| 3,414,324 | A | 12/1968 | Taylor et al. |
| 3,427,072 | A | 2/1969 | Hale |
| 3,514,153 | A | 5/1970 | Ferguson et al. |
| 3,554,598 | A | 1/1971 | Dunkin |
| 3,792,905 | A | 2/1974 | Johnson |
| 3,806,192 | A | 4/1974 | Ohlrogge et al. |
| 3,807,799 | A | 4/1974 | Freedman |
| 3,866,973 | A | 2/1975 | Heubeck |
| 3,874,728 | A | 4/1975 | Weiland |
| 3,889,998 | A | 6/1975 | Weiland |
| 3,934,928 | A | 1/1976 | Johnson |
| 3,984,146 | A | 10/1976 | Krestel et al. |
| 4,128,797 | A | 12/1978 | Murata |
| 4,264,849 | A | 4/1981 | Fleischer et al. |
| RE30,648 | E | 6/1981 | Ohlrogge et al. |
| 4,277,102 | A | 7/1981 | Aaras et al. |
| 4,351,562 | A | 9/1982 | Twitchell et al. |
| 4,426,071 | A | 1/1984 | Klevstad |
| 4,463,234 | A | 7/1984 | Bennewitz |
| 4,466,664 | A | 8/1984 | Kondou |
| 4,527,555 | A | 7/1985 | Ruf |
| 4,527,976 | A | 7/1985 | Behringer et al. |
| 4,541,671 | A | 9/1985 | Broadhead et al. |
| 4,586,748 | A | 5/1986 | Dingler et al. |
| 4,655,505 | A | 4/1987 | Kashiwamura et al. |
| 4,792,186 | A | 12/1988 | Benjamin et al. |
| 4,808,897 | A | 2/1989 | Saito et al. |
| 4,809,804 | A | 3/1989 | Houston |
| 4,913,393 | A | 4/1990 | Wood |
| 4,916,275 | A | 4/1990 | Almond |
| 4,956,592 | A | 9/1990 | Schulte et al. |
| 4,966,413 | A | 10/1990 | Palarski |
| 4,968,095 | A | 11/1990 | Moyer |
| 5,004,967 | A | 4/1991 | Ogasawara |
| 5,181,762 | A | 1/1993 | Beumer |
| 5,190,349 | A | 3/1993 | Austin, Jr. et al. |
| 5,214,360 | A | 5/1993 | Gonser et al. |
| 5,243,267 | A | 9/1993 | Ogasawara |
| 5,281,001 | A | 1/1994 | Bergsten et al. |
| 5,340,953 | A | 8/1994 | Krebs et al. |
| 5,369,805 | A | 12/1994 | Bergsten et al. |
| 5,375,276 | A | 12/1994 | Nelson et al. |
| 5,467,002 | A | 11/1995 | Brooks |
| 5,645,313 | A | 7/1997 | Best et al. |
| 5,653,499 | A | 8/1997 | Goodall |
| 5,665,059 | A | 9/1997 | Klearman et al. |
| 5,926,878 | A | 7/1999 | Morton et al. |
| 6,045,179 | A | 4/2000 | Harrison |
| 6,212,713 | B1 | 4/2001 | Kuck et al. |
| 6,217,119 | B1 | 4/2001 | Cook et al. |
| 6,238,002 | B1 | 5/2001 | Brewer et al. |
| 6,361,114 | B1 | 3/2002 | Rumler |
| 6,533,353 | B2 | 3/2003 | Johnston |
| 6,619,598 | B2 | 9/2003 | De Miranda |
| 6,691,350 | B2 | 2/2004 | Weismiller |
| 6,715,836 | B1 | 4/2004 | Chen et al. |
| 6,736,357 | B2 | 5/2004 | Venn et al. |
| 6,916,065 | B2 | 7/2005 | Park |
| 7,055,910 | B2 | 6/2006 | Wright |
| 7,108,318 | B2 | 9/2006 | Himmelhuber et al. |
| 7,108,328 | B2 | 9/2006 | Himmelhuber et al. |
| 7,171,709 | B2 | 2/2007 | Weismiller |
| 7,419,216 | B2 | 9/2008 | Hunziker |
| 7,452,032 | B1 | 11/2008 | Roleder et al. |
| 7,469,964 | B2 | 12/2008 | Baumann |
| 7,862,123 | B2 | 1/2011 | Baker et al. |
| 8,480,172 | B2 | 7/2013 | Baker et al. |
| 2004/0176668 | A1 | 9/2004 | Goldstein |
| 2005/0116514 | A1 | 6/2005 | Bufkin |
| 2005/0273022 | A1 | 12/2005 | Diaz et al. |
| 2011/0031785 | A1 | 2/2011 | Steenson |
| 2012/0255557 | A1 | 10/2012 | Baker et al. |
| 2013/0263863 | A1 | 10/2013 | Baker et al. |

FOREIGN PATENT DOCUMENTS

| | | | |
|---|---|---|---|
| EP | 1787619 | A2 | 5/2007 |
| FR | 2587663 | A1 | 3/1987 |
| GB | 2098859 | | 12/1982 |
| WO | WO 93/18575 | | 9/1993 |
| WO | WO 2013/181277 | A1 | 12/2013 |

OTHER PUBLICATIONS

Dental Products Report, advertisement for "Euro-Crusader", by Schein, Sep. 1991.
Brochure of Healthco "Aristocrat Deluxe" Dental Chair, as early as 1989.
Healthco International Brochure of "The Celebrity Dental Chair", 1987.
Brochure of PM 2002 CC, Planmeca Oy, 1981.
AMSCO, QUANTUM 3080RC Surgical Tables Brochure, 1988.
AMSCO, QUANTUM 3080RI Surgical Tables Brochure, 1990.
Midmark, Installation and Operation Manual: 712 Power Plastic Surgery Table, 1992.
Midmark, 712 Power Plastic Surgery Table, 1992 ("1992 Midmark 712B").
Midmark Medical Products, Parts List and Service Manual: Midmark Model 405 Medical Examination Table, 1988.
Midmark, 405 Power Examination Table Designer Series, 1991.
Midmark, Installation and Operation Manual: Model 411 Power Medical Examination Table, 1990.
Midmark, Equipment Specifications, 1986.
Midmark, Installation and Operation Manual: Model 414 Podiatry Treatment Chair, 1989.
Midmark, 414 Power Podiatry Surgery Table: Service and Parts Manual, 1994.
Midmark, 414 Power Podiatry Surgery Table: Designer Series, 1990.
Midmark, Installation and Operation Manual: Model 416 Podiatry Examination Chair, 1989.
Midmark, 416 Power Podiatry Examination Chair: Service and Parts Manual, 1994, rev. 2000.
Midmark, 416 Power Podiatry Examination Chair: Designer Series, 1989.
Midmark, Installation and Operation Manual: Model 417 Podiatry Treatment Chair, 1989.
Midmark, 417 Power Podiatry Treatment Chair: Designer Series, 1990.
Midmark, Chick Surgical Table Model SE 2001 Remote Control: Operator's Manual Maintenance Manual, at least as early as 1989.
Midmark, 411 Universal Power Table Designer Series, 1990.

ARTICULATED CHAIR HAVING UNIVERSAL RECLINING ARMREST SYSTEM

RELATED APPLICATIONS

This application is a continuation of U.S. patent application Ser. No. 12/982,815, entitled ARTICULATED CHAIR HAVING UNIVERSAL RECLINING ARMREST SYSTEM, filed Dec. 30, 2010, now U.S. Pat. No. 8,480172, which is a continuation of U.S. patent application Ser. No. 12/324,836, entitled ARTICULATED CHAIR HAVING UNIVERSAL RECLINING ARMREST SYSTEM, filed Nov. 27, 2008, now U.S. Pat. No. 7,862,123, which are all incorporated herein in their entirety.

BACKGROUND OF THE INVENTION

1. Field of the Invention

The present invention relates generally to positionable or articulated chairs and, more specifically, to an articulated chair incorporating a universal reclining armrest system. In particular, at least some embodiments of the present invention relate to an articulated chair operable to move between an upright position and a reclined position wherein an initial plane or a desired user-configured position of the armrest is maintained or substantially maintained throughout the chair's operable range of motion.

2. Background and Related Art

Articulated examination and treatment chairs are used to position a patient in any of a variety of different positions that may be selected in accordance with a particular procedure being performed and with reference to the preferences of the particular operator or doctor. For intravenous procedures utilizing the arm of the patient, such as intravenous infusions, anesthesia, dialysis, chemotherapy, phlebotomy, and platelet or plasma apheresis, the arm of the patient must be positioned in a generally extended position such that the antecubital region of the arm is clearly exposed. As such, the needle or catheter used for the intravenous procedure, as well as the vein of the patient remains free from occlusion or other perturbations that are generally incompatible with the procedure.

A proper positioning of the patient's arm is typically accomplished and maintained by an armrest attached to a portion of the articulated chair. While a generally upright position is preferred for most intravenous procedures, some procedures or patient conditions require that the chair be moved from an upright position to a reclined position during the intravenous procedure. Such repositioning not only changes the position of the chair and the patient, but also changes the position of the patient's arm. Such changes may result in an arm position that is undesirable or unfavorable for the intravenous procedure.

An articulated chair can be adjusted to accommodate various procedures, as well as various anatomic differences between patients. As such, a single chair will often require multiple sets of interchangeable armrests. The multiple sets of interchangeable armrests are commonly side specific, thereby requiring matched pairs of armrests to accommodate left-hand and right-hand procedures.

Thus, while various forms of armrests currently exist for articulated chairs, challenges still exist. Accordingly, it would be an improvement in the art to augment or even replace current armrest systems or techniques with other armrests or techniques.

SUMMARY OF THE INVENTION

The present invention relates generally to articulated chairs and, more specifically, to an articulated chair incorporating a universal reclining or pivoting system to hold or support the patient's arm. In particular, at least some embodiments of the present invention relate to an articulated chair operable to move between an upright position and a reclined position wherein an initial plane or a desired user-configured position of the armrest is maintained throughout the chair's operable range of motion.

Implementations of the present invention take place in association with an articulated chair having multiple hingedly coupled sections, such as a seat and leg rest section or a separate leg rest section, and a backrest section. In some implementations, the articulated chair further includes a base having means for moving the sections of the chair into desired configurations, such as into a reclined position, an upright position, and a semi-reclined position.

An articulated chair in accordance with the present invention further includes a pivoting mechanism by which an armrest assembly of the chair is maintained in a desired plane or position throughout the operable range of motion for the chair. Some implementations of the present invention further include an armrest adapter assembly that is reversibly coupled to a portion of the chair's pivoting mechanism. The armrest adapter assembly includes an adjustable aperture for receiving a post portion of an armrest. Thus, in some implementations of the present invention the armrest assembly is coupled to the pivoting mechanism of the chair via the armrest adapter assembly.

The armrest assembly generally includes a surface on which to hold or support an arm of a patient. In some embodiments, an armrest assembly is provided that is configured to hold a patient's arm in a position favorable for receiving and facilitating an intravenous catheter, needle, or procedure. In other embodiments, an ergonomic cushion is provided as part of the armrest assembly, wherein the ergonomic cushion is configured to hold the patient's arm in a position favorable for intravenous devices and procedures. Some armrest assemblies in accordance with the present invention further include an adjustable joint whereby the position, configuration, and orientation of the armrest platform is capable of being adjusted relative to the fixed position of the armrest adapter and pivoting mechanism. In other embodiments, the armrest assembly includes a fixed joint which fixes and maintains the position of the armrest platform relative to the fixed position or plane of the armrest adapter.

Finally, in some implementations of the present invention the armrest adapter is modified to include a channel that compatibly receives a sled portion of an armrest assembly. The sled portion is slidably coupled to the channel thereby allowing anterior and posterior adjustment of the armrest assembly relative to the armrest adapter. In some embodiments an adjustable joint, such as a ball joint, is interposed between the armrest assembly and the armrest adapter to provide further adjustment between the coupled components.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates generally to articulated chairs and, more specifically, to an articulated chair incorporating a universal reclining or pivoting system to hold or support the patient's arm. In particular, at least some embodiments of the present invention relate to an articulated chair operable to move between an upright position and a reclined position wherein an initial plane or a desired user-configured position of the platform of the armrest is maintained or substantially maintained throughout the chair's operable range of motion.

Figure 1:
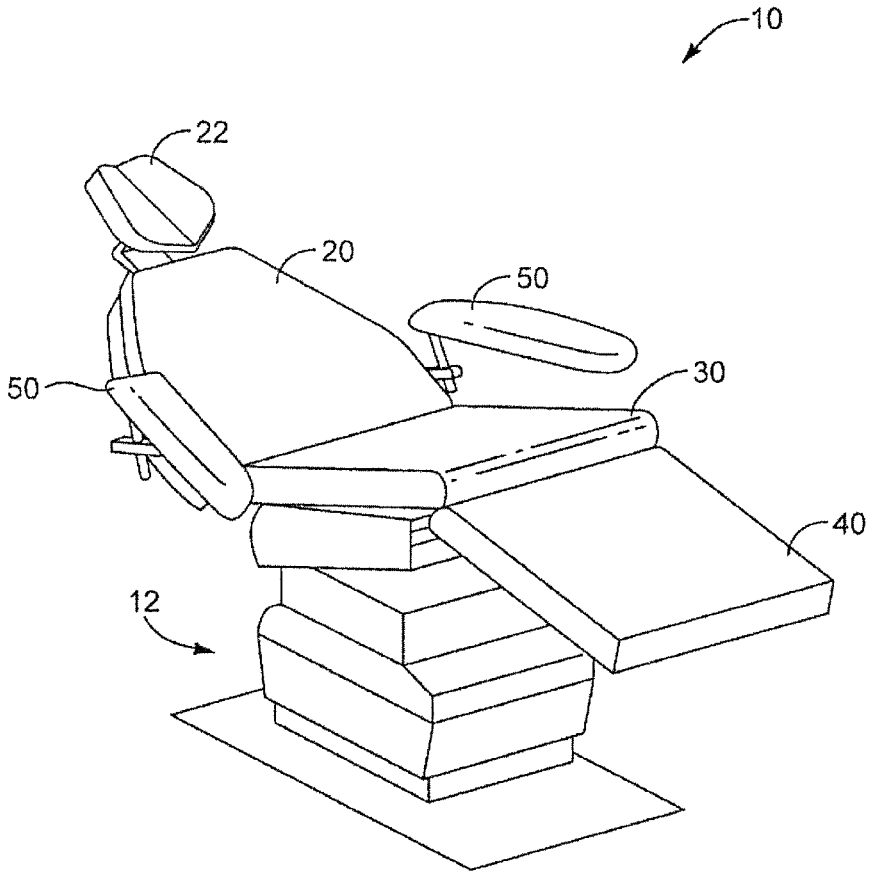
FIG. 1 is a perspective view of an articulated chair in accordance with a representative embodiment of the present invention.

Referring to FIG. 1, an articulated chair 10 in accordance with the present invention is shown. An articulated chair 10 generally includes multiple hingedly connected sections including a backrest 20, a seat 30, and a leg rest 40. In some embodiments, the chair 10 further includes a base 12 coupled to an underside of the seat 30 section. The base 12 generally includes gears and motors or hydraulics to enable movement and positioning of the various connected section 20, 30 and 40. For example, in some embodiments the base 12 enables the chair 10 to recline backwardly, to swivel, to rise, to lower, to tilt, to rotate, and to incline forwardly. In other embodiments, the base 12 includes a plurality of gears, motors, and/or hydraulics to enable various positioning of the chair 10. One of skill in the art will appreciate that various techniques and mechanics may be utilized to enable desired positions and orientations to the chair 10 as may be desired by a user.

The backrest 20, seat 30 and leg rest 40 sections of the chair 10 generally include a surface for supporting a patient, such as a cushioned surface. In some embodiments, the leg rest 40 section includes two sections (not shown); each section configured to independently support a leg of a patient. In other embodiments, the backrest 20, seat 30 and leg rest 40 sections further include ergonomic supporting surfaces to provide additional comfort to a seated patient.

The backrest 20 and leg rest 40 sections of the chair 10 are hingedly attached to or positioned relative to the seat section 30, thereby enabling the backrest 20 and the leg rest 40 to pivot relative to the seat section 30. In some embodiments, the backrest 20 and the leg rest 40 sections are integrally coupled such that when the backrest 20 is moved into a reclined position, the leg rest 40 automatically moves into an extended position. In other embodiments, the backrest section 20 moves independently of the leg rest section 40. In some embodiments, the proximal position of the backrest 20 and leg rest 40 sections to the seat section 30 may be adjusted inwardly and outwardly to accommodate patients of varying heights.

Figure 2:
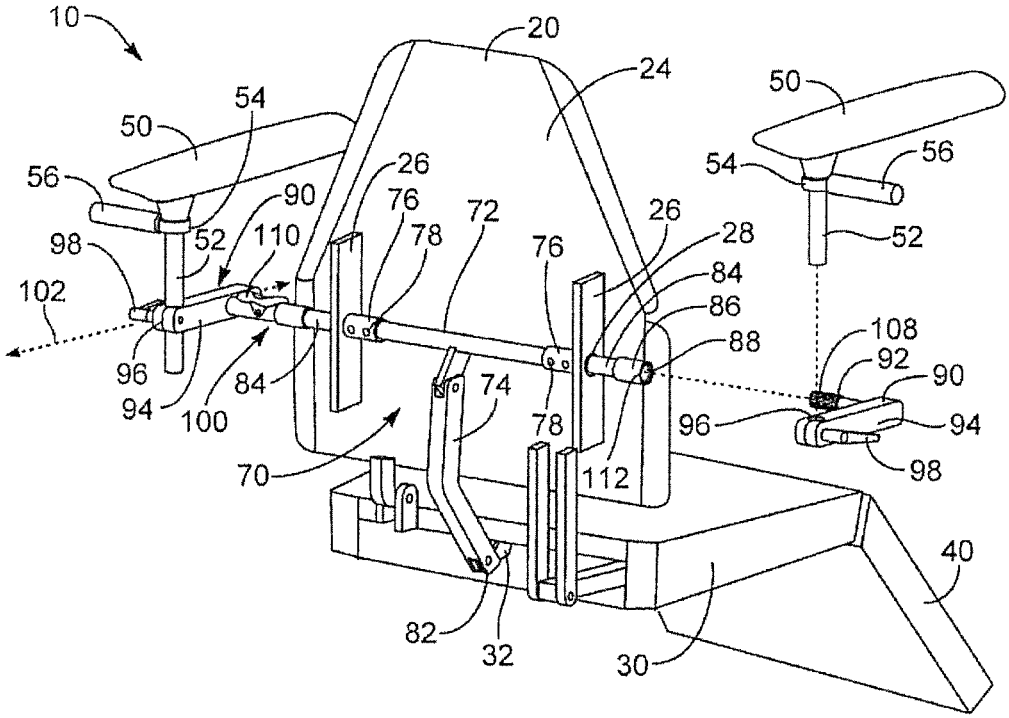
FIG. 2 is a perspective back view of an articulated chair demonstrating a universal pivoting mechanism in accordance with a representative embodiment of the present invention.

The backrest section 20 further includes a head rest 22 and a pair of armrests 50. The head rest 22 is adjustably coupled to an upper portion of the backrest 20, so as to support the head of a seated patient. As shown in FIG. 2 the armrests 50 are coupled to a back surface 24 of the backrest section 20 via a pivoting mechanism 70. The pivoting mechanism 70 comprises a cross-member 72 that is hingedly coupled to a control arm 74 via a first joint 80. The control arm 74 is further hingedly coupled to a rigid support member 32 of the seat section 30 via a second joint 82. The cross-member 72 comprises a first end and a second each, each of which is capped with an adapter arm 76. In some embodiments, the adapter arm 76 includes a sleeve portion into which an end of the cross-member 72 is fitted. In other embodiments, the cross-member 72 and adapter arms 76 are fastened together via a set screw 78 or other fastening means.

Figure 3:
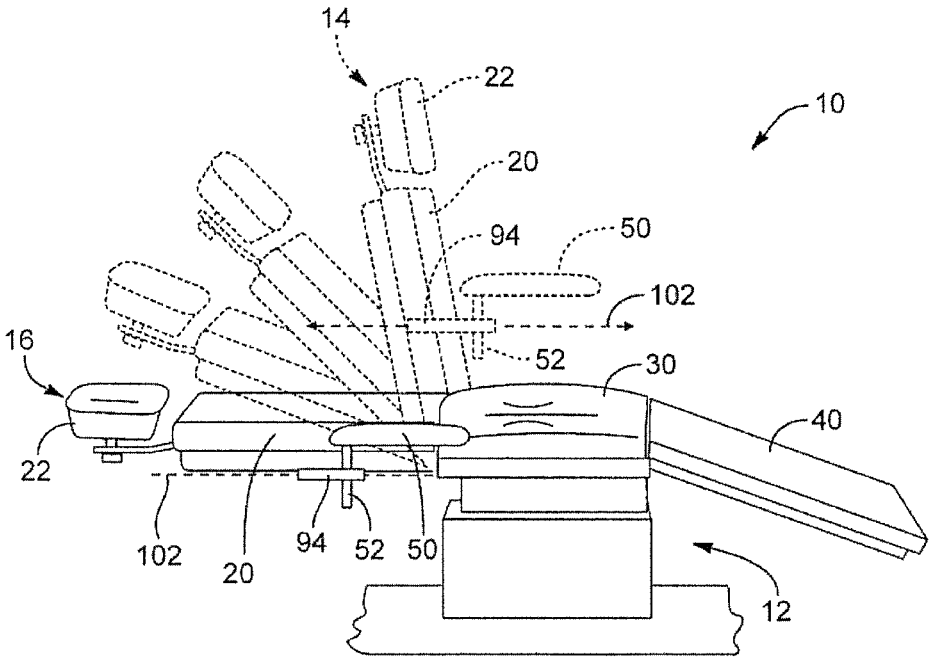
FIG. 3 is a perspective side view of an articulated chair in accordance with a representative embodiment of the present invention, where the chair is in a reclined position with various other positions shown in phantom.

The adapter arm 76 further includes a shaft 84 and a receiver 86, wherein the shaft 84 is interposed between the sleeve portion and the receiver 86 of the adapter arm 76. The adapter arm 76 is pivotally coupled to the back surface of the backrest 20 via support members 26. The shaft portion 84 of each adapter arm 76 is inserted through an aperture 28 of the support member 26 so as to allow the backrest 20 to pivot relative to seat 30 and the fixed position of the cross-member 72 as shown in FIG. 3.

With continued reference to FIG. 2, the pivoting mechanism 70 further includes a pair of armrest adapters 90. The armrest adapters 90 are interchangeably attached to the receiver 86 via a splined coupling 100, or another compatible coupling method. Specifically, a peg portion 92 of the armrest adapter 90 includes a plurality of splines 108 defining a shape. The receiver 86 includes a splined bore 88 defining a complementary shape to the plurality of splines 108. Thus, the peg portion 92 of the armrest adapter 90 is compatibly inserted within the splined bore 88 of the receiver 86. The peg portion 92 of the armrest adapter 90 is fixedly coupled to a universal clamp portion 94. In some embodiments, the peg portion 92 is coupled to the clamp portion 94 at approximately 90° relative to clamp portion 94. The universal clamp portion 94 includes an adjustable aperture 96 through which a post 52 of the armrest 50 is inserted and secured via a clamp screw 98.

The splined coupling 100 interlocks the universal armrest adapter 90 with the cross-member 72. In some embodiments, a retaining clip 110 is hingedly coupled to the peg portion 92 of the universal armrest adapter 90. The retaining clip 110 comprises a lip 120 (see FIG. 6) that reversibly engages a groove 112 on the receiver 86. The interaction of the retaining clip 110 and the groove 112 prevents unintended separation of the universal armrest adapter 90 from the receiver 86. As such, a desired plane 102 for the clamp portion 94 of the armrest adapter 90 is maintained or substantially maintained throughout the operable motion of the chair 10, as shown in FIG. 3.

In at least some embodiments, armrest adapter 90 is rotates such that aperture 96 is in front of peg portion 92.

Figure 4:
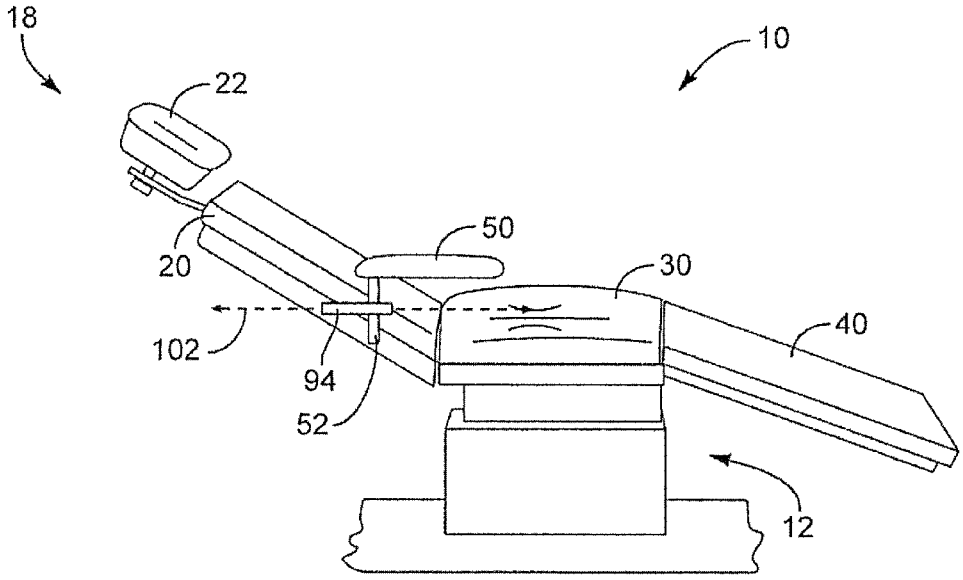
FIG. 4 is perspective side view of an articulated chair in a semi-reclined position in accordance with a representative embodiment of the present invention.

Referring now to FIG. 3, a side view of an articulated chair 10 in a reclined position is shown. Additional positions of the chair 10 are also shown in phantom. Of particular note is the upright, inclined position 14 (shown in phantom), and the reclined position 16. For each of these positions 14 and 16, a desired plane 102 for the clamp portion 94 of the pivoting mechanism 70 is maintained or substantially maintained. Thus, the pivoting mechanism 70, as shown in FIG. 2, maintains the desired plane 102 of the clamp portion 94 by allowing the backrest section 20 of the chair 10 to pivot relative to the cross-member 72, as discussed above. As shown in FIG. 4, a semi-reclined chair position 18 also maintains the desired plane 102.

Referring again to FIG. 2, some embodiments of the present invention include a ball joint clamp 54 coupling the armrest 50 to the post 52. A clamp screw 56 is further coupled to the ball joint clamp 54 to enable securing of the ball joint in a desired position or orientation. A hemispherical interface of the ball joint clamp 54 permits selective adjustment of the armrest 50 relative to the fixed position of the clamp portion 94. For example, in some embodiments the ball joint clamp 54 is adjusted and secured in a desired configuration that orients the armrest 50 in a downwardly angled position. In other embodiments, the ball joint clamp 54 is adjusted and secured to position the armrest 50 in an upwardly angled position. Still, in other embodiments the ball joint clamp 54 is adjusted and secured to position the armrest 50 in at least one of a tilted position, a slanted position, a prone position, a reverse position, an outwardly swiveled position, a backwardly tilted position, an inwardly swiveled position, and any combination position thereof.

Figure 5A:
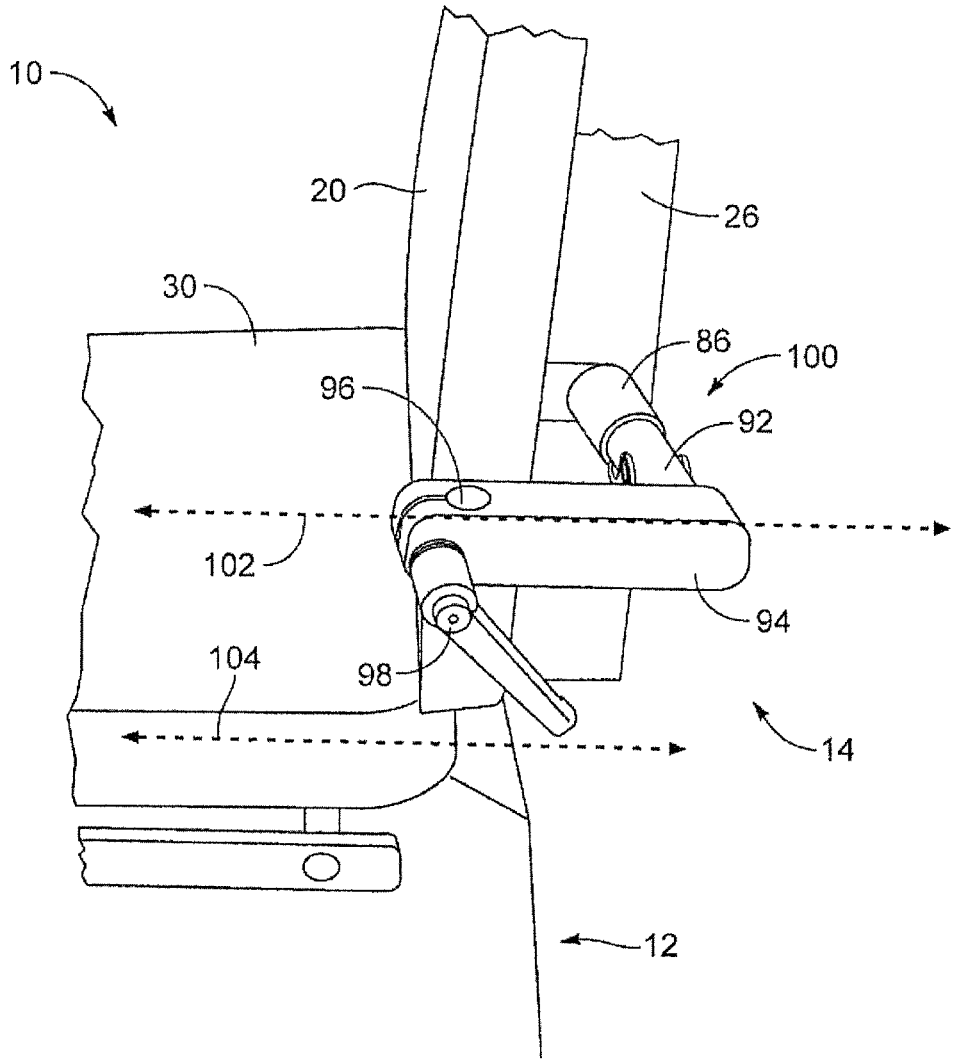
FIG. 5A is a perspective view of a clamp portion of a universal pivoting mechanism as attached to an articulated chair in an upright inclined position in accordance with a representative embodiment of the present invention.
Figure 5B:
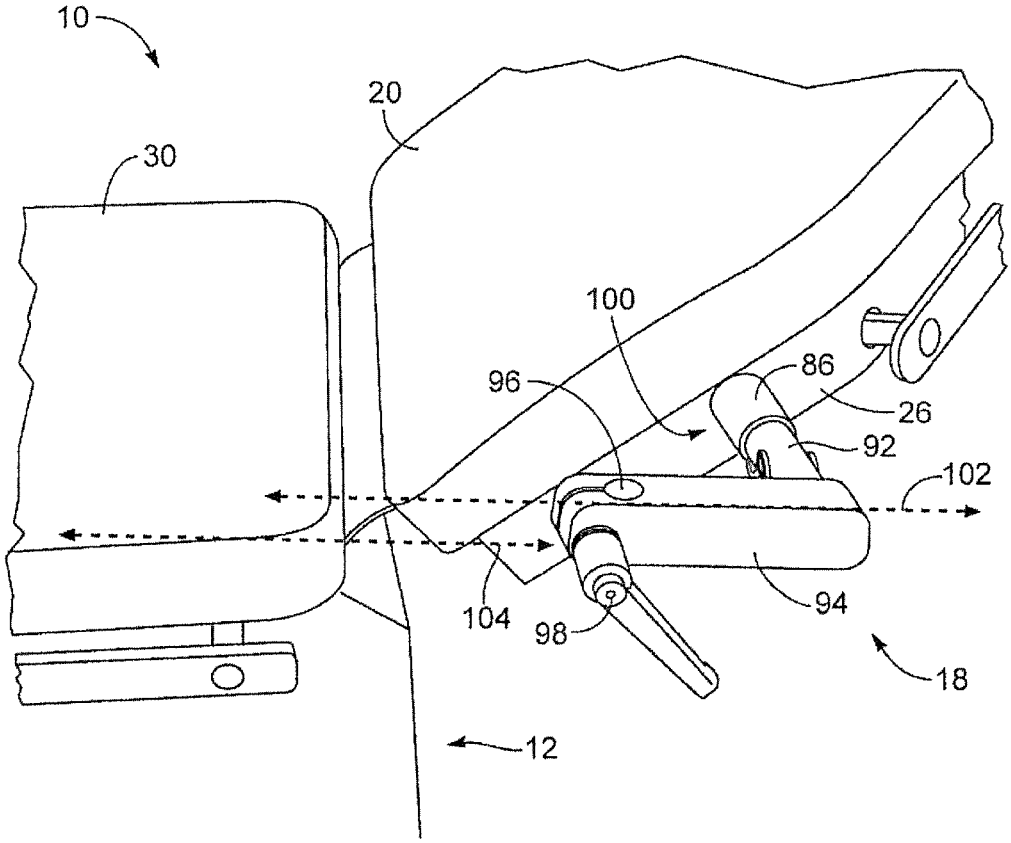
FIG. 5B is a perspective view of a clamp portion of a universal pivoting mechanism as attached to an articulated chair in a semi-reclined position in accordance with a representative embodiment of the present invention.
Figure 5C:
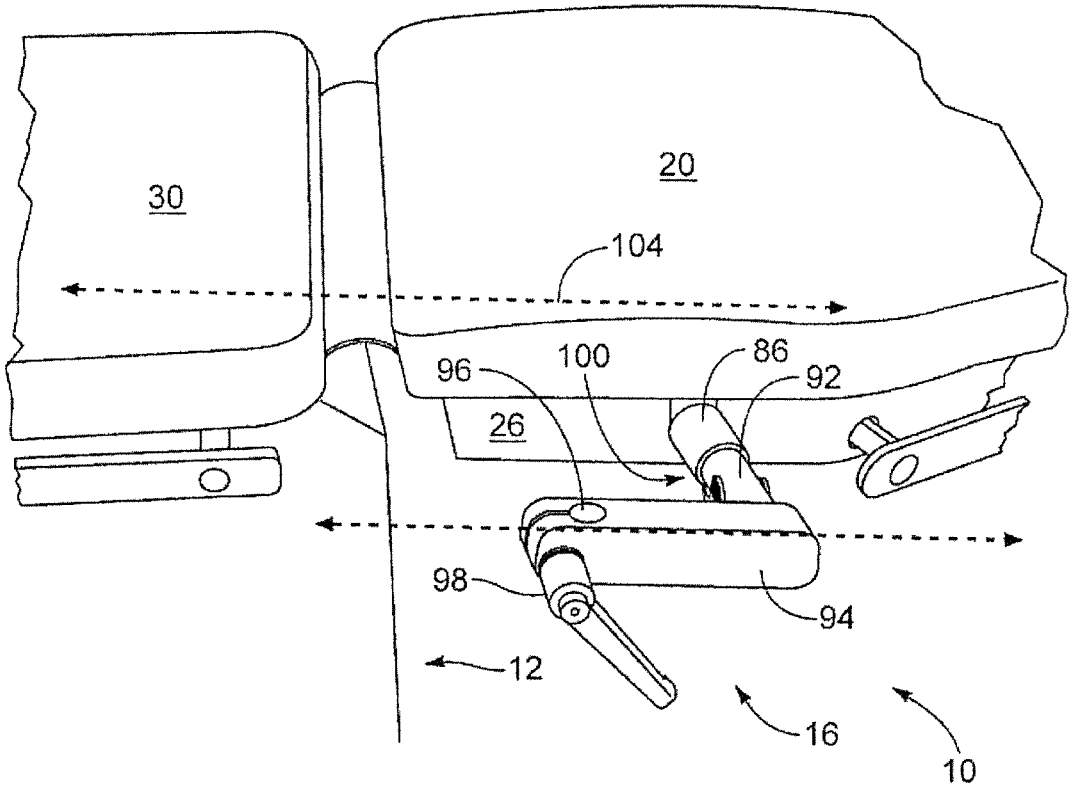
FIG. 5C is a perspective view of a clamp portion of a universal pivoting mechanism as attached to an articulated chair in a reclined position in accordance with a representative embodiment of the present invention.

Referring now to FIGS. 5A-5C, the desired plane 102 of the clamp portion 94 is maintained or substantially maintained throughout various positions of the articulated chair 10. Referring to FIG. 5A, the chair 10 is shown in an upright inclined position 14. In the upright inclined position 14, the desired plane 102 of the clamp portion 94 is generally parallel to the horizontal plane 104 of the seat section 30. In some embodiments, the splined coupling 100 is adjusted such that the desired plane 102 of the clamp portion 94 is generally perpendicular (not shown) to the horizontal plane 104 of the seat section 30. In other embodiments, the splined coupling 100 is adjusted within 360° such that the desired plane 102 of the clamp portion 94 varies from the horizontal plane 104 of the seat section 30 (not shown).

Referring now to FIG. 5B, the chair 10 is shown in a semi-reclined position 18. In the semi-reclined position 18, the desired plane 102 of the clamp portion 94 continues to be substantially parallel to the horizontal plane 104 of the seat section 30. Again, as shown in FIG. 5C the desired plane 102 continues to be substantially parallel to the horizontal plane 104 of the seat section when the chair 10 is configured in a fully reclined position 16.

Figure 6A:
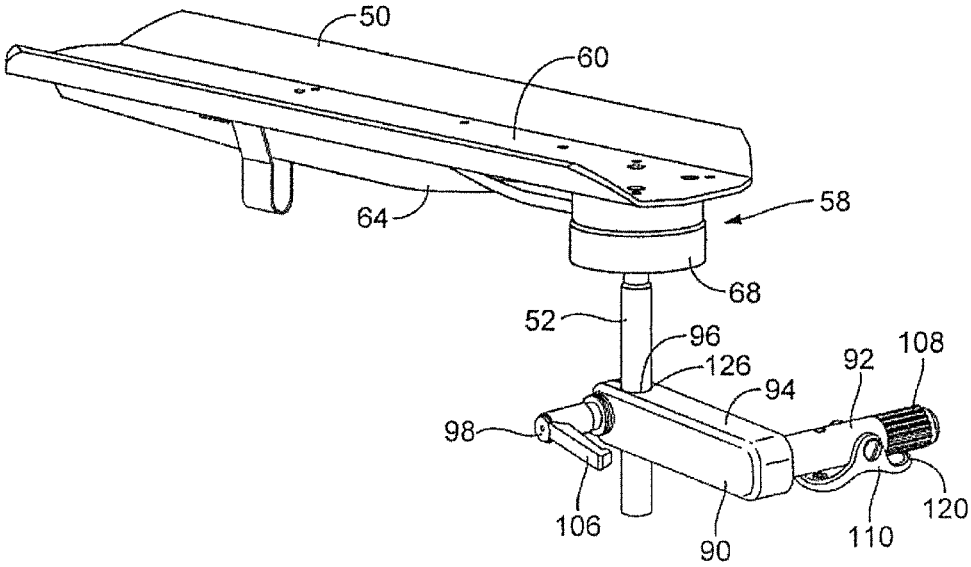
FIG. 6A is a perspective view of an armrest assembly coupled to a universal armrest adapter in accordance with a representative embodiment of the present invention.
Figure 6B:
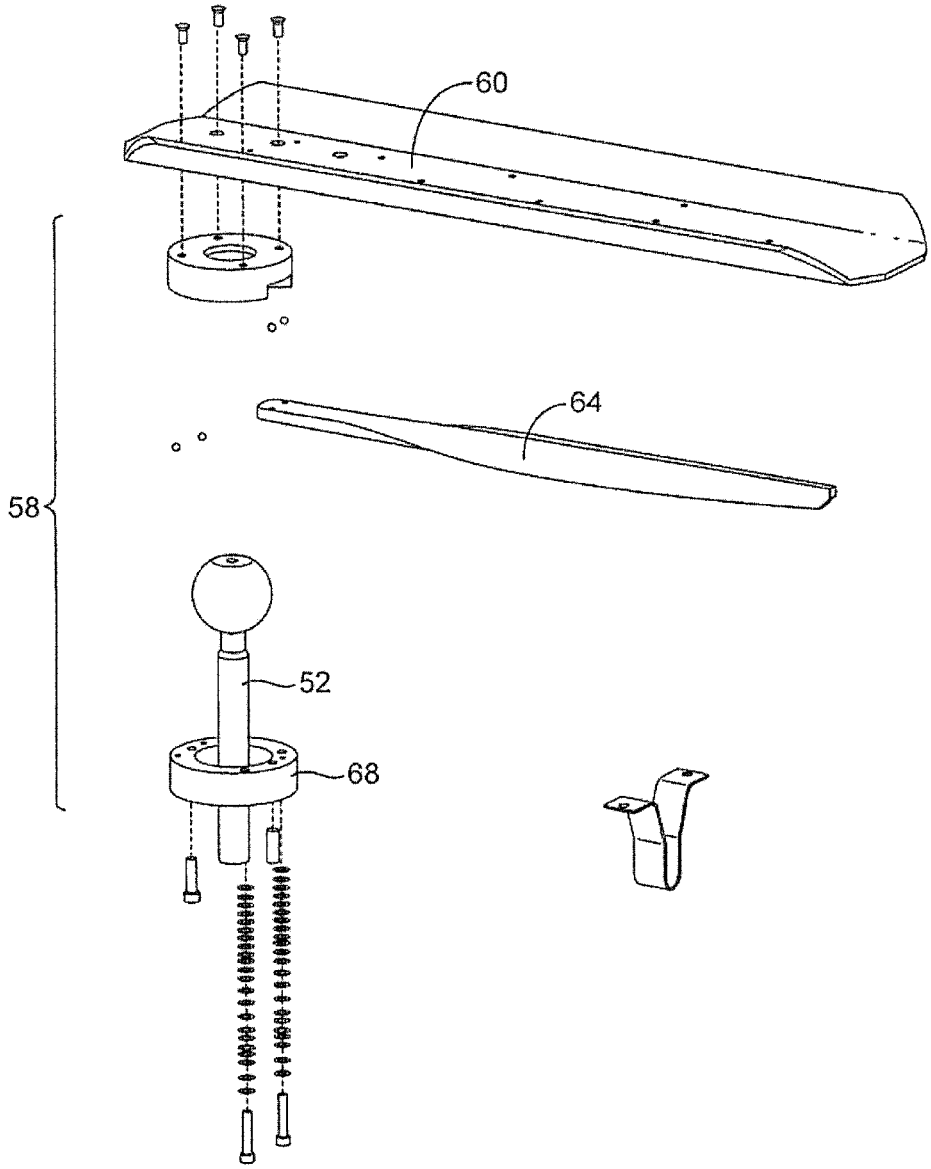
FIG. 6B is an exploded view of an armrest assembly that is configured to be coupled to a universal armrest adapter in accordance with a representative embodiment of the present invention.

Referring now to FIGS. 6A-11, various views and embodiments of the armrest 50 and related components are shown. With reference to FIG. 6A, an armrest platform 50 coupled to a universal armrest adapter 90 is shown. The armrest platform 50 is generally provided to support the arm of a user in a desired position. For example, in some embodiments the armrest 50 comprises a tray 60 configured to hold and position the forearm of a patient in a preferred position to receive an intravenous catheter. In other embodiments, the armrest 50 comprises an ergonomic cushion 62 (see FIG. 7) configured to hold and position the forearm of a patient in a preferred position to receive an intravenous catheter, or an intravenous needle. Still, in other embodiments the armrest 50 comprises at least one of a handle, a table surface, an instrument tray, and a mount adapted to receive a monitor, such as a computer monitor or display (not shown).

The armrest 50, or equivalent thereof, is coupled to a post 52 via a joint 58. In some embodiments, the joint 58 is provided to enable movement of the armrest 50 relative to the fixed position of the armrest adapter 90. As such, the joint 58 may comprise any coupling means including a ball joint (see FIG. 6B), a ratchet, a screw, a swivel, a pivot, a hinge, a gimbal, a socket, a bearing, a roller, a set of gears, a clamp, a vise, a shock absorber, a piston, and a spring, as well as a fixed joint such as a weld. In some embodiments, a handle 64 or other similar means is coupled to a portion of the joint to enable adjustments of the joint. As shown in FIG. 6A, the pivoting joint 58 is released or unlocked by lifting upward on the handle 64 thereby permitting lateral movement of the armrest 50 relative to the fixed position of the post 52 and the armrest adapter 90. Thus, when released or unlocked the assembly has the same degrees of movement as a ball joint. One of skill in the art will appreciate that a desired position of the armrest 50 may be obtained by selecting and implementing a joint 58 capable of providing the desired position.

Referring to FIG. 6A, the post 52 is coupled to a base portion 68 of the joint 58. The post 52 is adjustably coupled to the universal armrest adapter 90 via the aperture 96, which comprises a closed end 126 and an opened end 128, as more clearly shown in FIGS. 7 and 9. The opened end 128 is intersected by a clamp screw 98 that is capable of being tightened and loosened to secure or release the position of the post 52. In some embodiments, the clamp screw 98 further includes a handle 106 to facilitate adjustment of the clamp screw 98.

Figure 7:
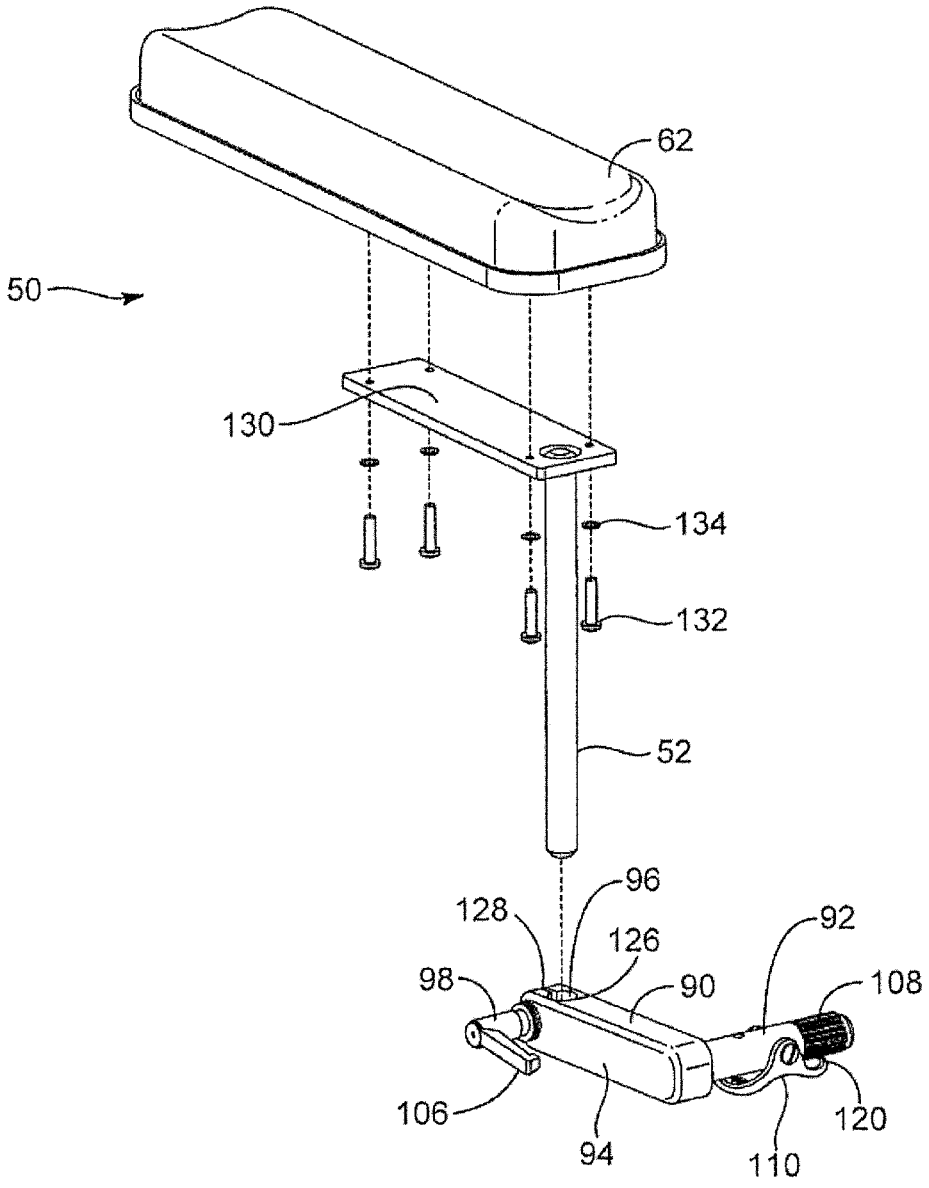
FIG. 7 is an exploded view of an armrest assembly and a universal armrest adapter in accordance with a representative embodiment of the present invention.

Referring now to FIG. 7, an exploded view of an armrest 50 is shown. In some embodiments, the armrest 50 is rigidly secured to the post 52 via a mounting plate 130. The mounting plate 130, as shown, is welded to the post 52 at a right angle. The ergonomic cushion 62 is secured to the mounting plate 130 via a plurality of screws or bolts 132 and washers 134. In some embodiments, a joint 58 is interposed between the post 52 and the mounting plate 130, as shown in FIGS. 8A-8B.

Figure 8A:
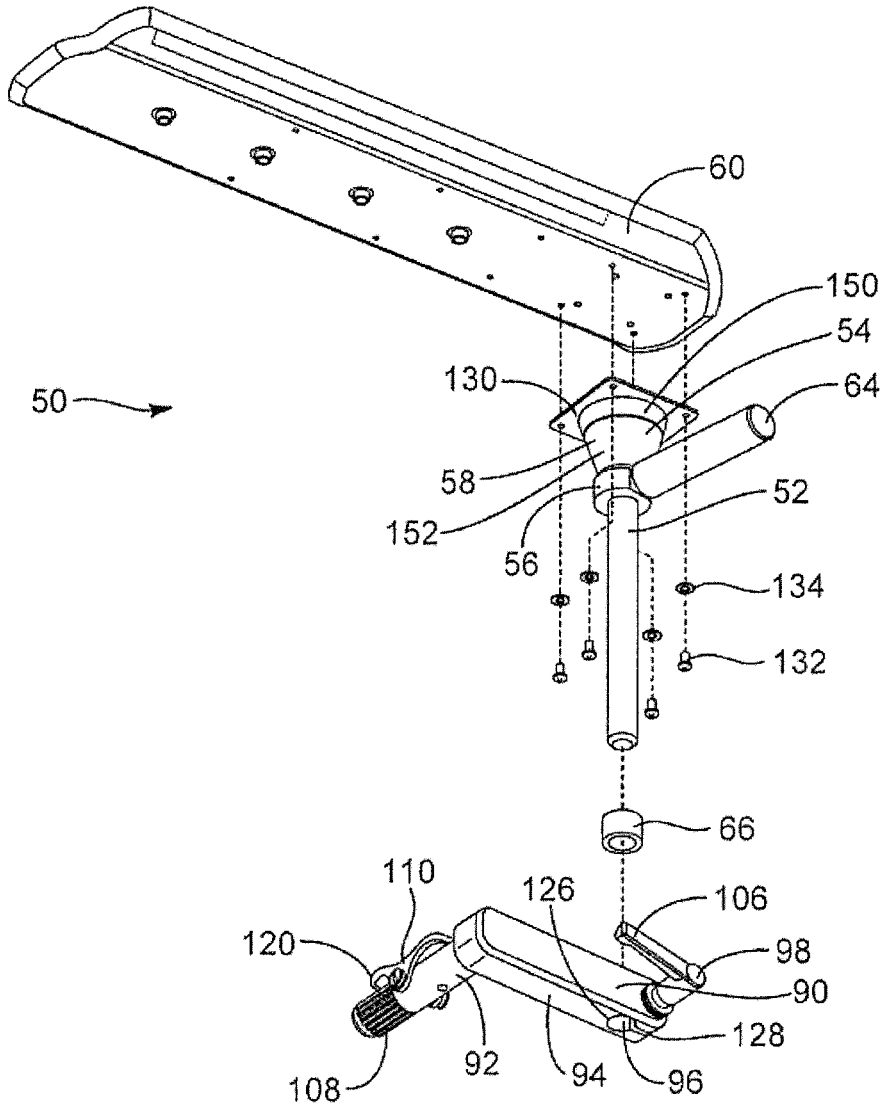
FIG. 8A is an exploded view of a universal armrest assembly designed for intravenous procedures and an armrest adapter in accordance with a representative embodiment of the present invention.
Figure 8B:
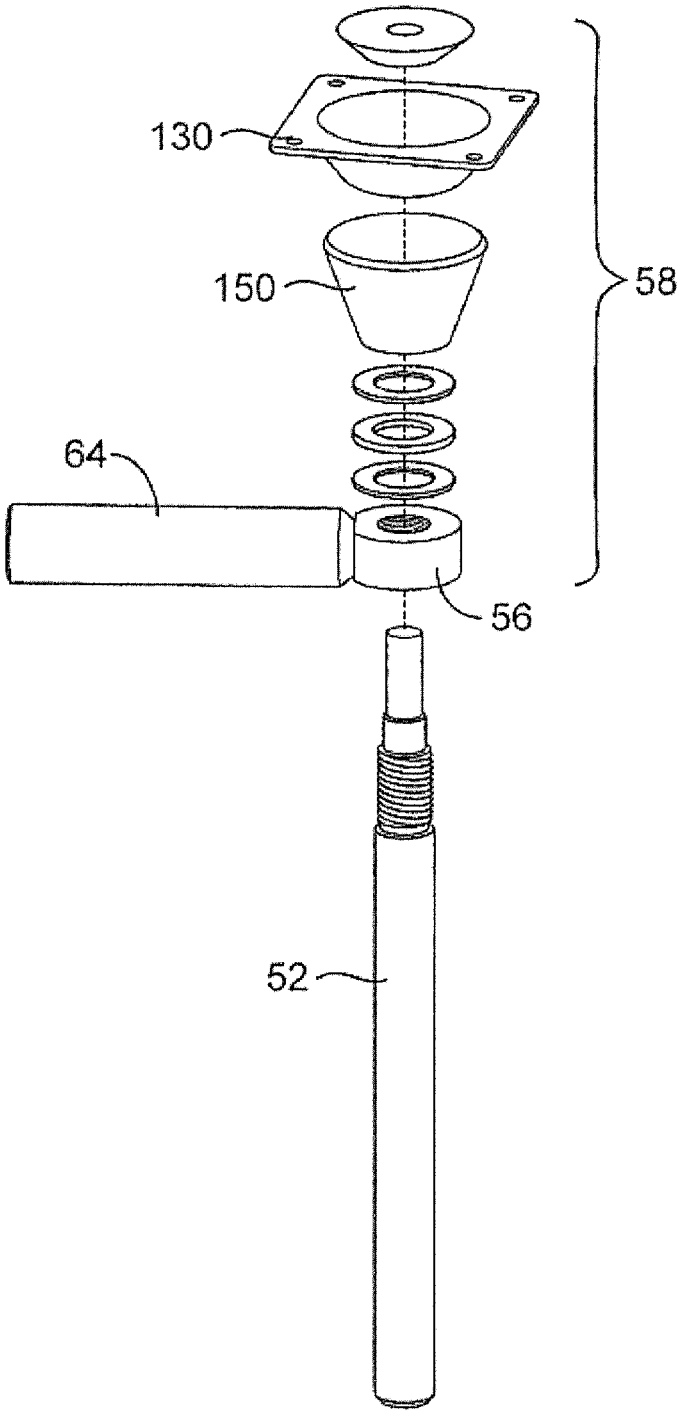
FIG. 8B is an exploded view of a portion of a universal armrest assembly designed for intravenous procedures and configured to be selectively coupled to an armrest adapter in accordance with a representative embodiment of the present invention.

Referring now to FIG. 8A, an exploded view of an armrest 50 is shown. The armrest 50 includes a tray 60 comprising ergonomic contours beneficial in positioning a patient's arm to receive an intravenous catheter or intravenous needle. The tray 60 is coupled to a joint 58 via a mounting plate 130 and a plurality of screws 132 and washers 134. In some embodiments, the joint 58 is a ball-type joint 54. A cup type portion 150 of the ball-type joint 54 is coupled to the mounting plate 130 and positioned to receive the ball type portion 152 of the ball type joint 54. A clamp screw 56 is further attached to portion 152 of joint 54 wherein the clamp screw 56 is capable of being tightened and loosened to secure or release the interface between portion 152 and portion 150 of joint 54. In some embodiments, a handle 64 is coupled to the clamp screw 56 to facilitate adjustment thereof.

In some embodiments, the diameter of the post 52 is too small to be adequately retained in the adjustable aperture 96. In some embodiments, a stop 66, such as a stop comprising rubber or a polymer material, is used to prevent clamp screw 56 from interfering with handle 106.

Figure 9:
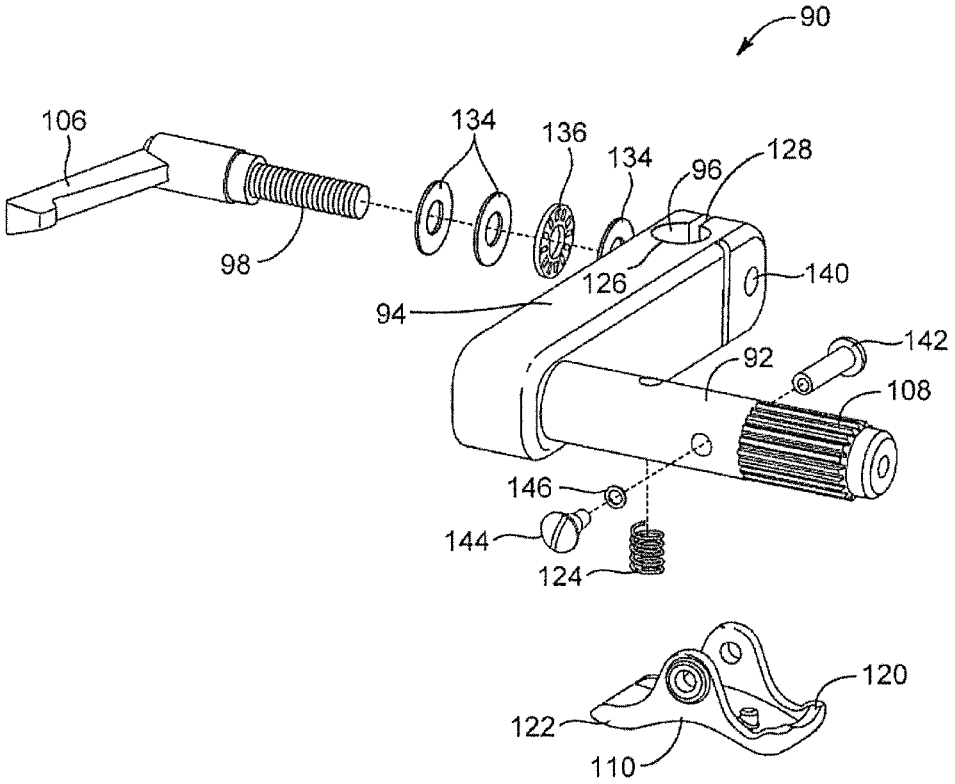
FIG. 9 is an exploded view of a universal armrest adapter in accordance with a representative embodiment of the present invention.

Referring now to FIG. 9, an exploded view of the armrest adapter 90 is shown. The open end 128 of the aperture 96 is intersected by a clamp screw 98 that is threadedly coupled to the clamp portion 94 of the armrest adapter 90 via a threaded channel 140. A plurality of washers 134 and a thrust bearing 136 are further interposed between a handle 106 end of the clamp screw 98 and clamp portion 94 of universal armrest adapter 90.

The peg portion 92 of the armrest adapter 90 further comprises a retaining clip 110. The retaining clip 110 straddles the peg portion 92 of the armrest adapter 90 and is secured thereto via a binding bolt barrel 142 and binding screw 144. In some embodiments, clip 110 is on the top of peg portion 92. In other embodiments, clip 110 is underneath peg portion 92. In some embodiments, clip 110 is on top of peg portion 92 when it is on one side of a chair and underneath peg portion 92 when it is on the other side of the chair. In some embodiments, a shim 146 is interposed between the retaining clip 110 and the peg portion 92 to provide spacing and lubrication between the adjacent components 110 and 92. The retaining clip comprises a lip portion 120 and a handle portion 122. In some embodiments, a compression spring 124 is interposed between the handle portion 122 and the peg portion 92 to bias the lip 120 inwardly towards the plurality of splines 108. In other embodiments, the lip 120 is configured to compatibly insert within a groove 112 located near the outer rim of the receiver 86, as shown and discussed in connection with FIG. 2 above.

Figure 10:
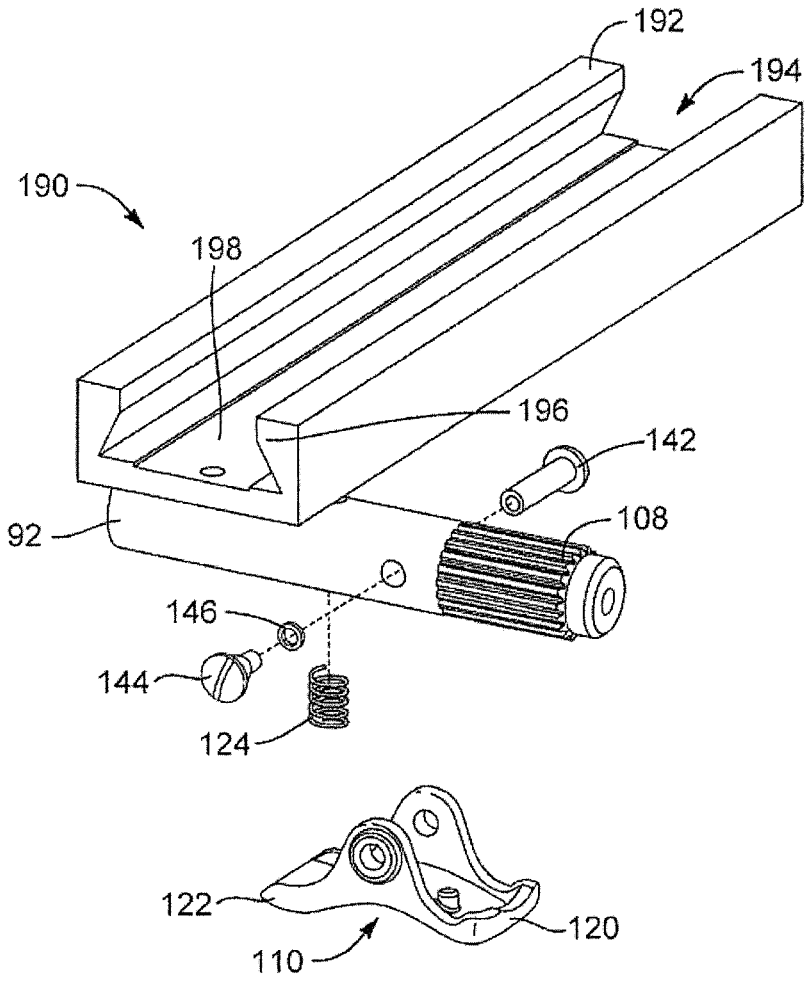
FIG. 10 is an exploded view of a universal armrest adapter incorporating a channel in accordance with a representative embodiment of the present invention.
Figure 11:
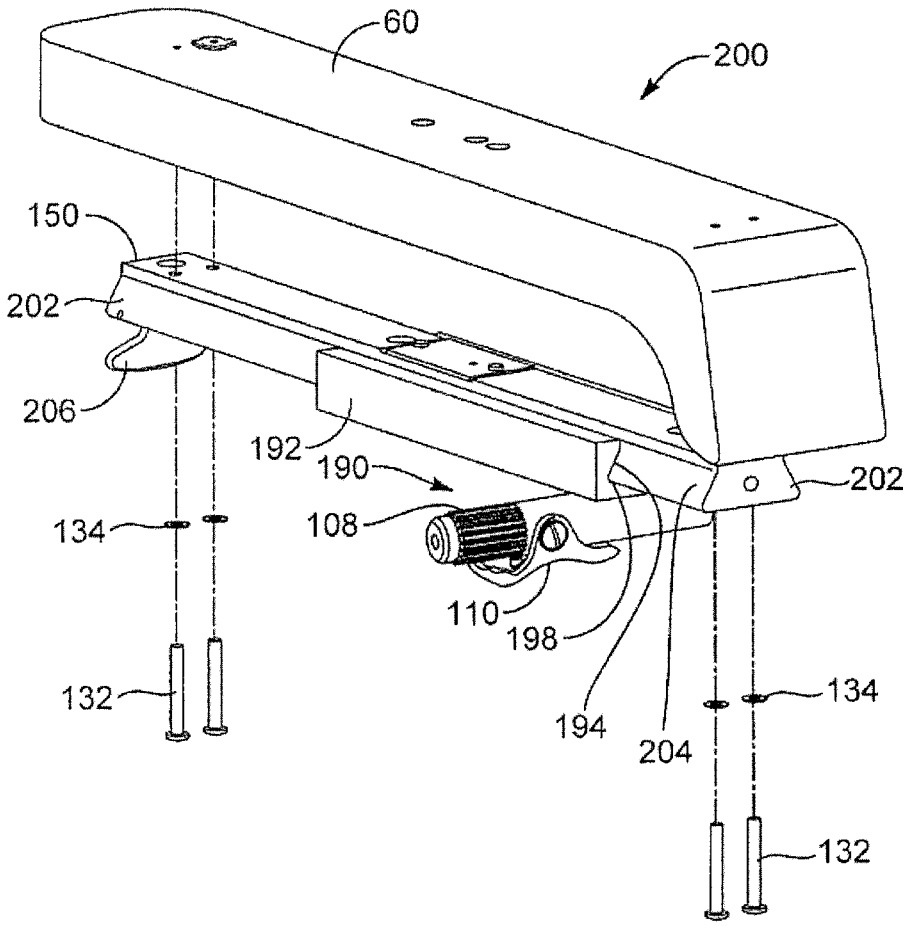
FIG. 11 is a perspective view of a universal armrest assembly and an armrest adapter in accordance with a representative embodiment of the present invention.

Referring now to FIG. 10, an implementation of a universal armrest adapter 190 is shown. In some embodiments of the present invention, the clamp portion 94 of the armrest adapter 90 is replaced with a channel adapter 192. The channel adapter 192 comprises an opening 194 into which a sled portion 202 of an armrest 200 is inserted, as shown in FIG. 11. The channel adapter 192 is fixedly coupled to the peg portion 92 of the armrest adapter 190. In some embodiments, an inner surface 196 of the opening 194 is inwardly chamfered to provide a chamfered channel 198.

Referring now to FIG. 11, an armrest 200 is shown as inserted in the chamfered channel 198 of the universal armrest adapter 190. In some embodiments, the armrest 200 includes a sled portion 202 having a chamfered surface 204 that compatibly and slidably inserts within the chamfered channel 198. In other embodiments, the sled portion 202 of the armrest 200 further includes a pressure plate (not shown) that biases downwardly against the inner surface 196 of the chamfered channel 198. The pressure plate therefore upwardly biases the chamfered surface 204 of the sled portion 202 against the inner surface 196 of the chamfered channel 198 to interlock the two components 200 and 190 in a desired position. In some embodiments, the sled portion 202 further includes a release lever 206 whereby the pressure plate is released to permit selective movement and adjustment of the sled portion 202 within the chamfered channel 198. One of skill in the art will appreciate that various methods of coupling the components 190 and 200 may be used within the spirit of the present invention.

Figure 12A:
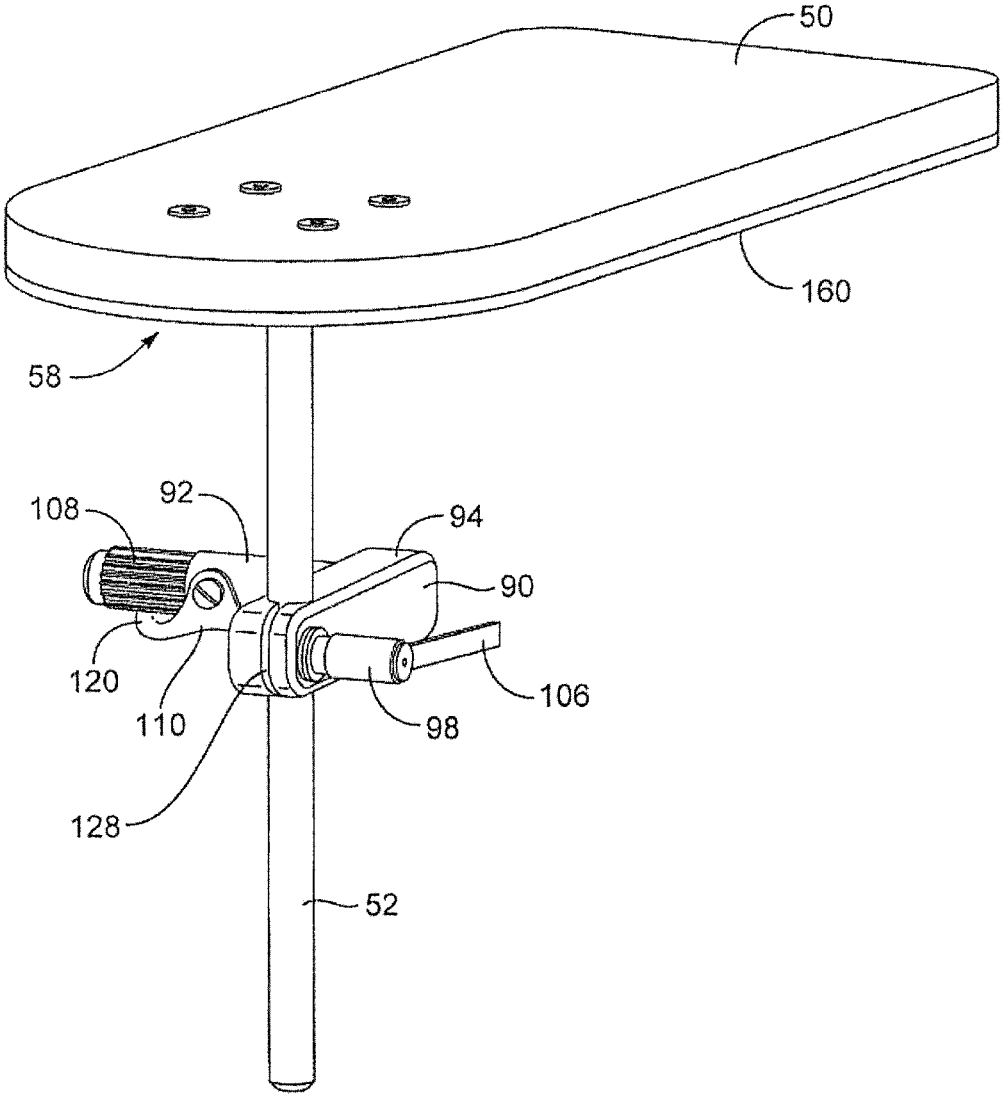
FIG. 12A is a perspective view of a universal armrest assembly and armrest adapter in accordance with a representative embodiment of the present invention.
Figure 12B:
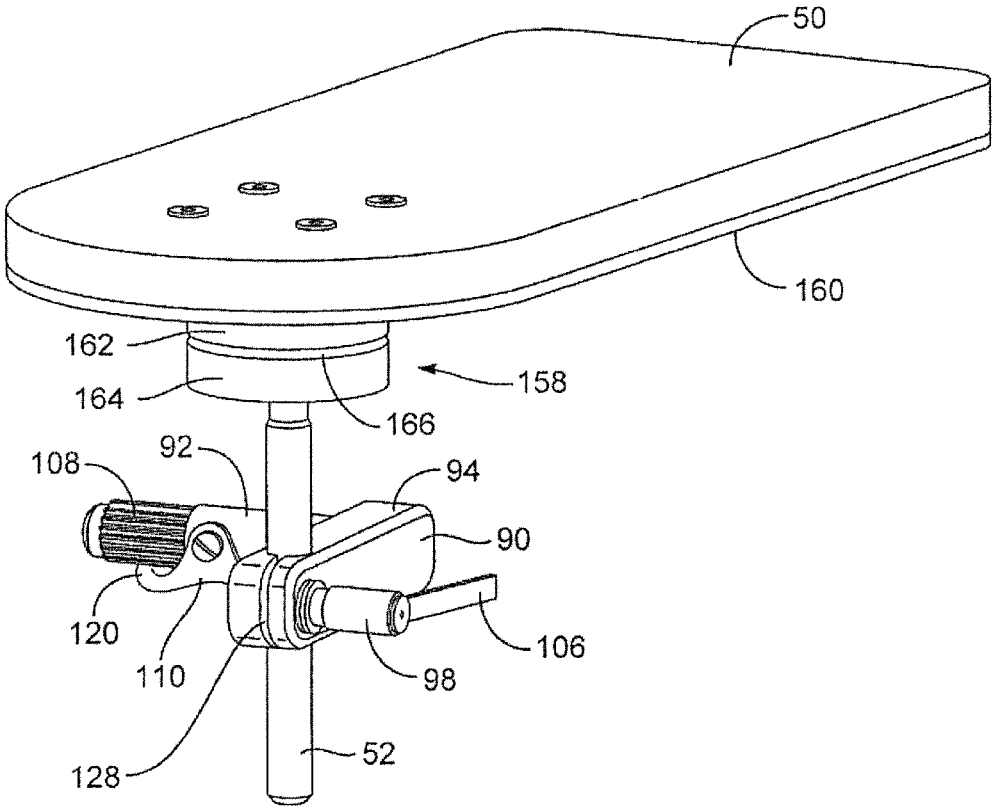
FIG. 12B is a perspective view of a universal armrest assembly and armrest adapter in accordance with a representative embodiment of the present invention.
Figure 12C:
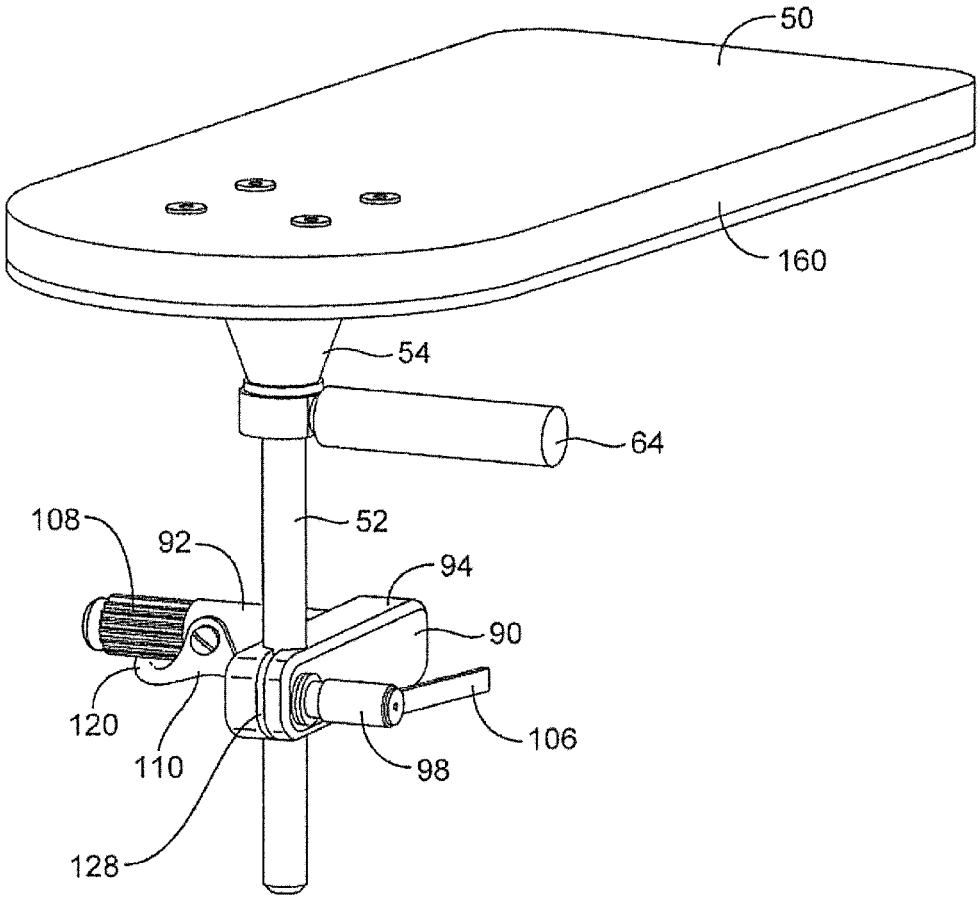
FIG. 12C is a perspective view of a universal armrest assembly and armrest adapter in accordance with a representative embodiment of the present invention.

Referring now to FIGS. 12A-12C, various additional embodiments of an armrest 50 and universal armrest adapter 90 are shown. Referring to FIG. 12A, a platform-type armrest 160 is coupled to post 52 via a non-adjustable joint 58, such as a welded joint. Referring to FIG. 12B, a platform-type armrest 160 is coupled to post 52 via a deluxe ball lock joint 158. The deluxe ball lock joint 158 comprises a top, disk-like portion 162 that is fixedly coupled to an undersurface of the armrest 160, and further includes a bottom, disk-like portion 164 that is fixedly coupled to the post 52. The top portion 162 and the bottom portion 164 are pivotally coupled to one another whereby the platform-type armrest 162 is permitted to pivot relative to the fixed position of the post 52. In some embodiments, the interface between the top portion 162 and the bottom portion 164 further includes a plurality of bearings 166 that are seated in a race (not shown). In some embodiments, the race includes a plurality of recessed surfaces (not shown) into which the bearings are seated to maintain a desired position of the armrest 160 relative to the post 52. Finally, referring to FIG. 12C, a platform-type armrest 160 is coupled to a post 52 via a ball-type joint 54. The ball-type joint 54 permits 360° of rotational adjustment to the armrest 160 relative to the fixed position of the post 52 and armrest adapter 90, as previously discussed.

Thus, as discussed herein, the embodiments of the present invention generally relate to positionable or articulated chairs and, more specifically, to an articulated chair incorporating a universal reclining armrest system. In particular, at least some embodiments of the present invention relate to an articulated chair operable to move between an upright position and a reclined position wherein an initial plane or a desired user-configured position of the armrest is maintained or substantially maintained throughout the chair's operable range of motion.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An interchangeable armrest system comprising:

an articulated chair having a backrest and a seat, the backrest being adjustable with respect to the seat over an operable range of motion; and a first armrest interchangeably coupled to a first portion of the backrest at a first orientation relative to a surface of the seat, the chair being configured to substantially maintain the first orientation of the first armrest throughout the operable range of motion, the first armrest being selectively removable from the first portion of the backrest and being interchangeably coupleable with a second portion of the backrest, the second portion being configured to hold the first armrest at a second orientation relative to the surface of the seat such that the second orientation of the first armrest is substantially maintainable throughout the operable range of motion.

2. The system of claim 1, wherein when the first armrest is coupled to the first portion of the backrest, the first armrest is configured to move from a first position that is configured to support a user's arm when the user is in a sitting position on the chair, to a second position that is configured to support the user's arm when the user is in a prone position on the chair.

3. The system of claim 1, wherein the first armrest comprises a post that is configured to couple within an armrest adapter that is interchangeably coupleable to both the first portion and the second portion of the backrest

4. The system of claim 3, wherein the armrest adapter comprises an aperture that is configured to receive the post.

5. The system of claim 1, wherein the first armrest comprises a post that is configured to be received within an armrest adapter that couples to the first portion of the backrest, and wherein the armrest adapter is configured to selectively allow the post to be rotatably adjustable within the armrest adapter and to allow the post to be selectively locked in and released from a desired position with respect to the armrest adapter.

6. The system of claim 1, wherein the first armrest comprises a post that is configured to be received within an armrest adapter that couples to the first portion of the backrest, and wherein the post is configured to be slidably received within armrest adapter such that the first armrest is configured to be selectively raised and lowered to, and locked into and released from, multiple positions above the surface of the seat.

7. The system of claim 1, wherein the first armrest comprises a post that is configured to be received within an armrest adapter that couples to the first portion of the backrest, and wherein the armrest adapter is configured to selectively lock the post in a desired position in which the post is prevented from rotating with respect to the armrest adapter.

8. An interchangeable armrest system comprising:

an articulated chair having a backrest and a seat, the backrest being adjustable with respect to the seat over an operable range of motion; and a first armrest interchangeably coupled to a first portion of the backrest at a first orientation relative to a surface of the seat, the chair being configured to substantially maintain the first orientation of the first armrest with respect to the surface of the seat throughout the operable range of motion, the first armrest being selectively removable from the first portion of the backrest and being interchangeably coupleable with a second portion of the backrest, the second portion being configured to hold the first a armrest at a second orientation relative to the surface of the seat such that the second orientation of the first armrest is substantially maintainable with respect to the surface of the seat throughout the operable range of motion, wherein the first armrest comprises a post and wherein an armrest adapter defining an aperture couples to the first portion of the backrest, the post being configured to be inserted into the aperture to interchangeably couple the first armrest to the first portion of the backrest.

9. The system of claim 8, wherein the first armrest is interchangeably coupleable with the first portion of the backrest at a plurality of different orientations with respect to the surface of the seat.

10. The system of claim 8, wherein when the first armrest is attached to the first portion of the backrest, the first armrest is configured to move from a first position that is configured to support a user's arm when the user is in a sitting position on the chair, to a second position that is configured to support the user's arm when the user is in a prone position on the chair.

11. The system of claim 8, wherein the first armrest comprises a post that is configured to be received within an armrest adapter that is interchangeably coupleable with the first portion and the second portion of the backrest, and wherein the armrest adapter is configured to selectively allow the post to be rotatably adjustable within the armrest adapter and to allow the post to be selectively locked in and released from a desired position with respect to the armrest adapter.

12. The system of claim 8, wherein the first armrest comprises a post that is configured to be received within an armrest adapter that couples to the first portion of the backrest, and wherein the post is configured to be slidably received within armrest adapter such that the first armrest is configured to be selectively raised and lowered to, and locked into and released from, multiple positions above the surface of the seat.

13. The system of claim 8, where the first orientation of the first armrest with respect to the surface of the seat comprises an orientation in which a surface of the first armrest runs substantially parallel with the surface of the seat.

14. The system of claim 8, wherein the armrest comprises a post that is configured to interchangeably be received by a first armrest adapter coupled to the first portion of the backrest and to a second armrest adapter coupled to the second portion of the backrest.

15. The system of claim 8, wherein the aperture includes an open portion that is intersected by a clamp screw, the clamp screw being selectively tightenable and loosenable to adjust a size of an inner perimeter of the aperture.

16. An interchangeable device system comprising:

an articulated chair having a backrest and a seat, wherein the backrest and the seat are adjustable with respect to each other over an operable range of motion of the chair;

a first device adapter that is coupleable with a first device and that is interchangeably coupleable to a first portion of the backrest at a first desired orientation relative to a surface of the seat, the chair being configured to substantially maintain the first desired orientation of the first device adapter with respect to the surface of the seat throughout the operable range of motion, the first device adapter being selectively removable from the first portion of the backrest, and being interchangeably coupleable with a second portion of the backrest, the second portion being configured to hold the first device adapter such that the first device adapter is at a second desired orientation relative to the surface of the seat, and such that the second desired orientation of the first device adapter with respect to the surface of the seat is substantially maintained throughout the operable range of motion.

17. The system of claim 16, wherein the first device adapter defines an aperture configured to receive a post extending from the first device and to selectively lock the post in, and release the post from, a desired position with respect to the adapter.

18. The system of claim 17, wherein the first device adapter is configured to prevent the post from rotating within the adapter when the post is selectively locked in the desired position.

19. The system of claim 16, wherein the first device comprises an intravenous armrest having a surface for supporting an arm of a user.

20. The system of claim 16, wherein when the first armrest is coupled to the first portion of the backrest, the first armrest is configured to move from a first position that is configured to support a user's arm when the user is in a sitting position on the chair, to a second position that is configured to support the user's arm when the user is in a prone position on the chair.

21. The system of claim 16, wherein the first armrest comprises a post that is configured to be received within an armrest adapter that couples to the first portion of the backrest, and wherein the post is configured to be slidably received within armrest adapter such that the first armrest is configured to be selectively raised and lowered to, and locked into and released from, multiple positions above the surface of the seat.

* * * * *